United States Patent [19]

Schwartz

[11] Patent Number: 4,627,209

[45] Date of Patent: Dec. 9, 1986

[54] INTERLOCKING BLOCKS AND CONSTRUCTION SYSTEM COMPRISING SAID BLOCKS

[76] Inventor: Ervin J. Schwartz, 70071 C.R.3, R.R. 3, Nappanee, Ind. 46550

[21] Appl. No.: 723,528

[22] Filed: Apr. 15, 1985

[51] Int. Cl.[4] ..... E04C 1/10

[52] U.S. Cl. ..... 52/589; 52/593

[58] Field of Search ..... 52/439, 592, 593, 594, 52/603, 605, 606

[56] References Cited

U.S. PATENT DOCUMENTS

| | | | |
|---|---|---|---|
| 2,911,818 | 11/1959 | Smith | 52/594 |
| 2,994,162 | 8/1961 | Frantz | 52/421 |
| 3,012,377 | 12/1961 | Sunukjian | 52/603 |
| 3,478,482 | 11/1969 | Weir | 52/594 |
| 4,075,808 | 2/1978 | Pearlman | 52/592 |
| 4,182,089 | 1/1980 | Cook | 52/594 |
| 4,301,637 | 11/1981 | Anderson | 52/603 |

FOREIGN PATENT DOCUMENTS

| | | | |
|---|---|---|---|
| 332606 | 2/1921 | Fed. Rep. of Germany | 52/592 |
| 816742 | 8/1951 | Fed. Rep. of Germany | 52/589 |
| 2353614 | 5/1975 | Fed. Rep. of Germany | 52/439 |
| 56663 | 10/1952 | France | 52/589 |
| 1149985 | 1/1958 | France | 52/594 |
| 63536 | 1/1949 | Netherlands | 52/592 |
| 112341 | 1/1925 | Switzerland | 52/594 |
| 375042 | 6/1932 | United Kingdom | 52/591 |
| 536434 | 5/1941 | United Kingdom | 52/439 |

*Primary Examiner*—Henry E. Raduazo

*Attorney, Agent, or Firm*—Norman B. Rainer

[57] ABSTRACT

A monolithic masonry building block capable of controlled alignment in vertical and horizontal directions provides a wall structure having vertical and horizontal grooves which can be filled with a bonding agent. The block is comprised of sidewalls and transverse walls that interlock with similar components of adjacent identical blocks.

5 Claims, 14 Drawing Figures

INTERLOCKING BLOCKS AND CONSTRUCTION SYSTEM COMPRISING SAID BLOCKS

BACKGROUND OF THE INVENTION

The present invention relates generally to novel building block construction elements and to a building construction system utilizing interlocking modular block members which can be used to form continuous wall sections without the need for mortar.

Attempts have been made in the past to overcome the shortcomings and disadvantages of conventional masonry structures utilizing building elements such as bricks, cement blocks, cinder blocks and the like. Such conventional masonry elements are used for erecting wall structures on an appropriate foundation by way of laying successive superimposed horizontal rows or courses of bricks or blocks united by means of horizontal and vertical mortar joints. Such mortar joints often show poor adherence to the surfaces of the masonry elements, and are relatively porous with the result that they are not entirely impervious to seepage of water or penetration by moisture. Mortar joints are consequently the weakest element of a wall, or other structure, build by conventional means, they provide a poor barrier to heat, cold, moisture, and they deteriorate relatively more rapidly than the rest of the structure. Furthermore, building a structure by means of conventional masonry united by vertical and horizontal mortar joints requires substantial skill on the part of the worker in order to trowel the right amount of mortar of the right consistency at each joint and in order to constantly maintain courses upon courses of bricks or building blocks perfectly level and a plurality of superimposed courses along a perfect plumb line. It is also obvious that in addition to being relatively slow, time consuming, and requiring a reasonable amount of care and skill, conventional building systems utilizing masonry elements interconnected by vertical and horizontal mortar joints are subject to cracking at the mortar joints which form the weakest part of the whole structure.

As a result of the deficiencies of the prior art technique, various interlocking or mortarless blocks have been proposed. According to the prevailing theory, interlocking blocks are so constructed that they may be layed one upon the other, to lay up a wall without the necessity of skilled tradesmen to align the blocks one upon the other, to apply the mortar, and to position the blocks appropriately.

The mortarless or interlocking blocks provided thus far have been deficient in several respects. The typical prior art interlocking block is manufactured by the usual molding process and then the various interconnecting grooves and protrusions are formed into the block by sawing or other forming techniques. Such a block becomes impractically expensive for most applications.

A further deficiency of prior art interconnecting or mortarless blocks has been that the interlocking structure has required very precise molding or other forming so that usual manufacturing techniques cannot be employed. Thus, the blocks must be made according to low producing processes which raises the costs beyond practical limits.

Other prior art techniques have not provided blocks which are adaptable to use with corner blocks and end blocks to accomplish the intersection and termination of walls without the use of manual forming and the accompanying skill and labor requirements. Additionally, some prior art techniques have required that the blocks be joined by mortar in the conventional fashion and therefore have been wasteful of material and labor in the joining operation.

As a result of the deficiencies of prior art mortarless or interconnecting blocks, these blocks have seen relatively limited application and the conventional prior art technique with its concommitant high labor and skill requirement is the predominating usage.

It is accordingly an object of the present invention to provide interlocking self-aligning building blocks having a design amenable to economical manufacturing.

It is another object of this invention to provide interlocking blocks as in the foregoing object and associated complementary interactive blocks constituting a system for the facile fabrication of wall structures.

These objects and other objects and advantages of the invention will be apparent from the following description.

SUMMARY OF THE INVENTION

The above and other beneficial objects and advantages are accomplished in accordance with the present invention by a building block of integral monolithic construction comprising:

(a) two identical sidewalls of rectangular perimeter, each having (1) an interior surface, (2) a flat exterior surface, (3) a flat straight upper abutment edge surface which spans the distance between said interior and exterior surfaces, (4) a lower edge disposed below the corresponding upper abutment edge and parallel thereto in spanning relationship between said interior and exterior surfaces and having at least two steps, the first of said steps being a flat straight abutment surface contiguous to said interior surface, the second of said steps extending between said first step and said exterior surface, and positioned closer to said upper abutment edge than said first step, and (5) first and second vertical edge surfaces of flat straight configuration perpendicularly disposed between said interior and exterior surfaces, the corresponding several edge surfaces of the two sidewalls being in coplanar alignment, and (b) first and second transverse walls located adjacent said first and second vertical edge surfaces, respectively, and disposed between the facing interior surfaces of said sidewalls in perpendicular spanning relationship therewith, each trasverse wall being of substantially rectangular perimeter and bounded by a flat exterior abutment surface, an interior surface, and upper and lower edge surfaces perpendicularly disposed between interior and exterior surfaces of the transverse wall, the lower edge surfaces of said transverse walls being disposed below the lower edge surfaces of said sidewalls, the upper edge surfaces of said transverse walls being disposed below the upper edge surfaces of said sidewalls, the positioning of said first transverse wall being such that its exterior abutment surface is located forwardly of said first vertical edge surfaces, and the positioning of said second transverse wall being such that its exterior abutment surface is inwardly displaced from said second vertical edge surfaces in the direction of said first transverse wall, whereby (c) the lower extremities of the transverse walls of the building block make snug interlocking contact with the interior surfaces of the sidewalls of an underlying building block of the same construction, and (d) when placed end to end, the first transverse wall of a building block partially enters the interior space between the sidewalls of a next adjacent building block, interlocking therewith and causing the flat exterior abutment surface of the first transverse wall of one building block to contact the flat exterior abutment surface of the second transverse wall of the next horizontally adjacent building block.

In preferred embodiments of the invention, the building blocks are provided with a third transverse wall located midway between the first and second transverse walls and parallel thereto. In other embodiments, connecting shoulders span the distance between the transverse walls adjacent their lower extremities as continuous downward extensions of the interior surfaces of the sidewalls, said shoulders terminating in a downwardly facing surface coplanar with the lower edge surfaces of said transverse walls. In further embodiments, the interior surfaces of the sidewalls are downwardly tapered in an inwardly convergent manner, thereby causing the sidewall to be thicker at the bottom of the block, said increased thickness accommodating the presence of said shoulders.

Other complementary blocks are provided, adapted to interact with the primary building block as a system in a manner capable of providing smooth flat construction structural walls of desired dimensions.

BRIEF DESCRIPTION OF THE DRAWING

For a fuller understanding of the nature and objects of the invention reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
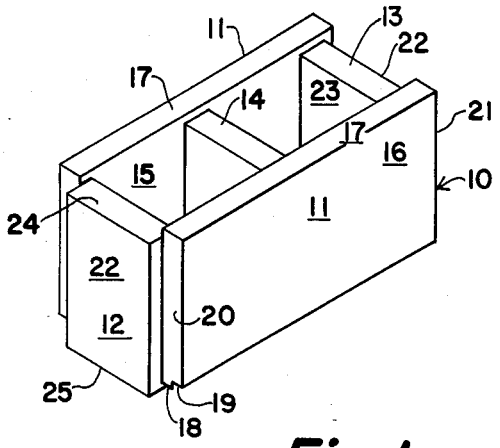
FIG. 1 is a top perspective view of an embodiment of the primary building block of the present invention.

Referring to FIGS. 1, 2, 4 and 5, a monolithic concrete primary building block 10 of the present invention is shown comprised of two identical sidewalls 11 in association with first, second and middle transverse walls 12, 13 and 14 respectively.

Each sidewall has a rectangular perimeter having interior surface 15, flat exterior surface 16, flat upper abutment edge surface 17 which spans the distance between said interior and exterior surfaces, and a lower edge having a two-step configuration, the first step 18 being a flat straight abutment surface contiguous to interior surface 15 and disposed directly below and parallel to corresponding upper edge surface 17, and the second step 19 extending between said first step and exterior surface 16 as a flat straight surface disposed below upper edge surface 17 and closer thereto than said first step 18. Said first and second step surfaces are preferably of equal width. Each sidewall is further bounded by first and second vertical edge surfaces 20 and 21, respectively, of flat straight configuration perpendicularly disposed between interior and exterior surfaces 15 and 16, respectively. It is to be noted that the corresponding several edge surfaces of the two sidewalls of block 10 are in coplanar alignment.

First transverse wall 12 is located adjacent first vertical edge surfaces 20 of the sidewalls and disposed between facing interior surfaces 15 in perpendicular spanning relationship therewith. The transverse wall is of rectangular perimeter, and bounded by flat exterior abutment surface 22, interior surface 23, and paired uppereand lower edge surfaces 24 and 25, respectively, perpendicularly disposed between interior and exterior surfaces 23 and 22 of the transverse wall and interior surfaces 15 of said sidewalls. The lower edge surfaces 25 of the transverse walls are displaced below the first step surfaces 18 of said sidewalls. The upper edge surfaces 24 of the transverse walls are displaced below the upper abutment surfaces 17 of the sidewalls.

Said first transverse wall is positioned such that its exterior abutment surface 22 is displaced forwardly of first vertical edge surfaces 20. Second transverse wall 13 is positioned such that its exterior abutment surface 22 is inwardly displaced from second vertical edge surfaces 21 of the sidewall in the direction of first transverse wall 12. The displacements of opposed abutment surfaces 22 with respect to their associated vertical edge surfaces are equal and of a magnitude ranging between about $\frac{1}{4}$ and $\frac{3}{4}''$.

The displacements of upper and lower edge surfaces 24 and 25, respectively, with respect to the corresponding upper and lower edge surfaces of the sidewall are equal and of a magnitude ranging between about $\frac{1}{4}''$ and $\frac{3}{4}''$.

Figure 2:
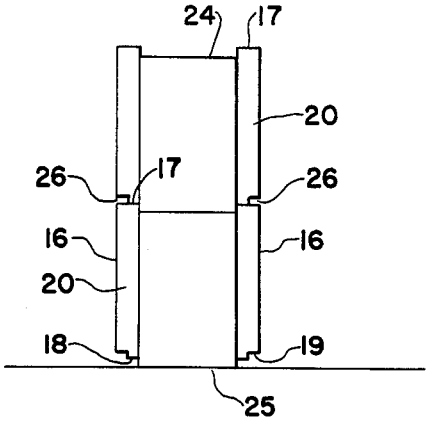
FIG. 2 is an end view of two building blocks of FIG. 1 in stacked assembly.
Figure 3:
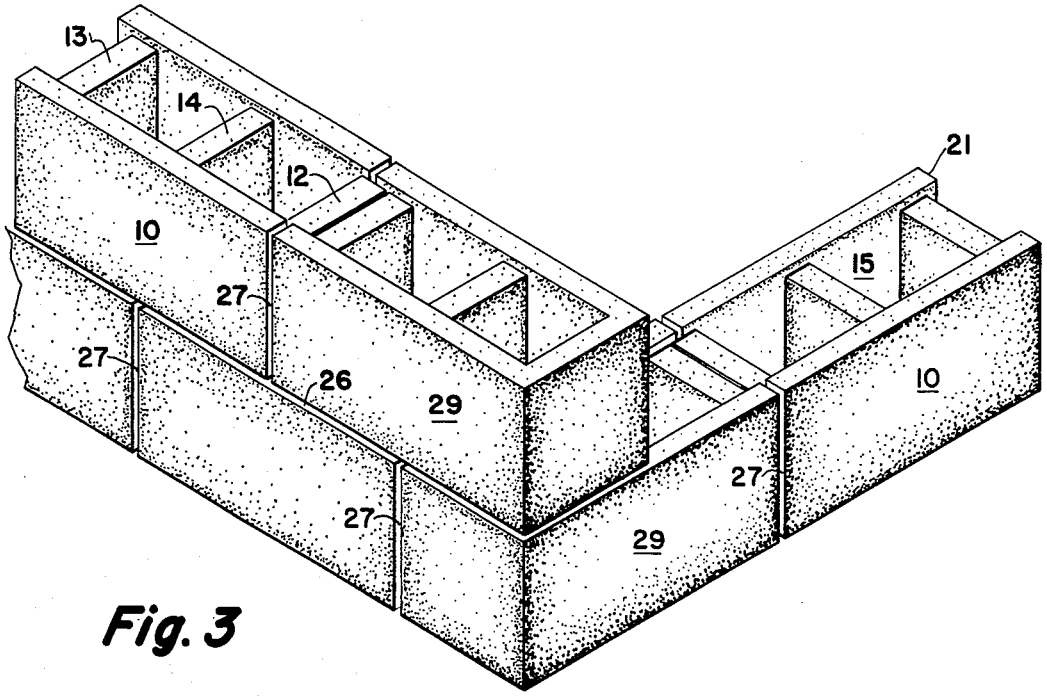
FIG. 3 is a perspective fragmentary view of a wall comprised of building blocks of FIG. 1 in stacked and horizontal assembly.
Figure 4:
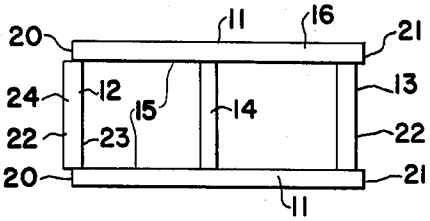
FIGS. 4 and 5 are top and bottom views, respectively, of the block of FIG. 1.
Figure 5:
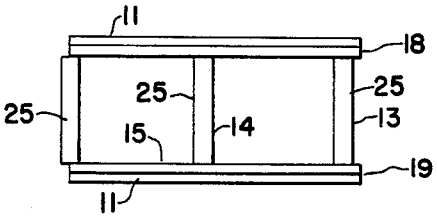
Figure 6:
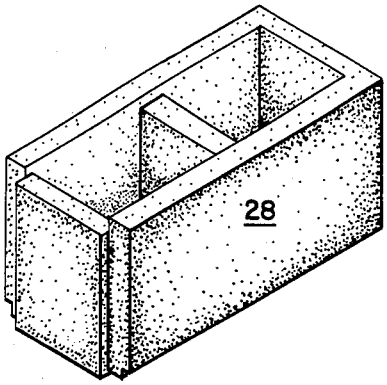
FIGS. 6 and 7 are perspective views of right side and left side end blocks, respectively, adapted to interact with primary building blocks in producing a structural wall.
Figure 7:
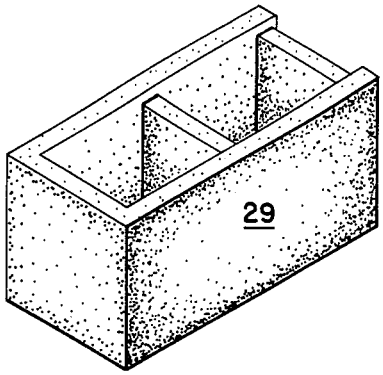
Figure 8:
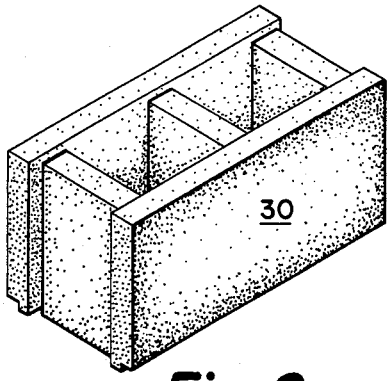
FIG. 8 is a perspective view of a splicing block adapted to interact with primary building blocks.
Figure 9:
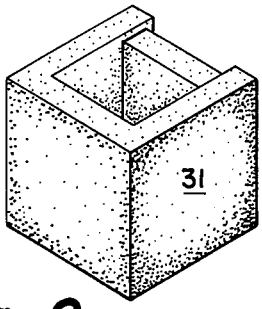
FIGS. 9 and 10 are perspective views of a half block and filler piece, respectively, useful in association with the primary building block to construct a wall structure.
Figure 11:
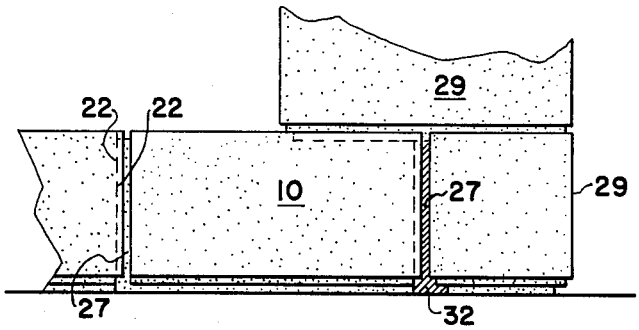
FIG. 11 is a fragmentary side view of an embodiment of a wall constructed from the system of building blocks of the present invention.

By virtue of the displacements of the transverse walls with respect to the sidewalls, the lower extremities of the transverse walls fit snugly within the space between interior surfaces 15 of the sidewalls of an underlying building block, as shown in FIGS. 3 and 11. Such manner of interlocking causes a wall construction to be vertically true and bolsters the wall against lateral forces. When properly stacked, as shown in FIG. 2, the first step surface 18 is brought into abutment with upper edge surface 17 of an underlying building block. Such mode of interengagement forms a continuous horizontal trough 26 which can be filled in after construction of the wall using mortar or other bonding agents, to form a strong, highly impervious wall construction.

When the building blocks are placed in end-to-end engagement, as shown in FIG. 11, the outer abutment surfaces 22 of the transverse walls will come into contact, thereby inducing horizontally true alignment of the blocks and imparting strength to the assembly. Such end-to-end engagement further produces vertically disposed troughs 27 which communicate with horizontal troughs 26, and can likewise be filled by mortar or other bonding agents.

Figure 10:
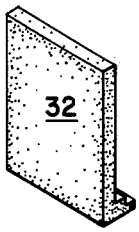

The modified blocks of FIGS. 6–9, and the filler piece of FIG. 10 are designed to accommodate various assembly configurations that may be encountered in the course of the construction of a wall. Said modified blocks interact with the primary block 10 to provide continuity of troughs 26 and 27 and provide a smooth-surfaced wall of desired dimensions. It is to be noted that abutment wall 33 of filler piece 32 is adapted to fit between interior surfaces 15 and in abutment with abutment surfaces 22.

Figure 12:
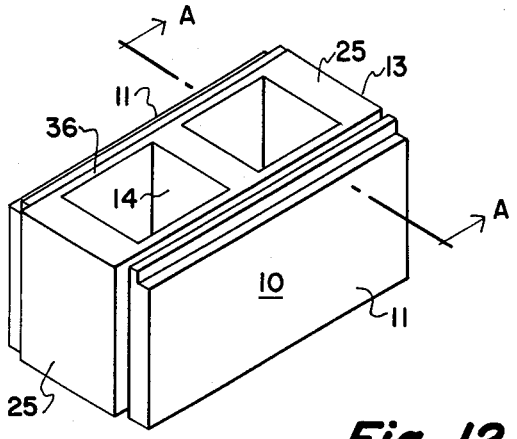
FIG. 12 is a perspective view of an alternative embodiment of the primary building block of the present invention in inverted position.
Figure 13:
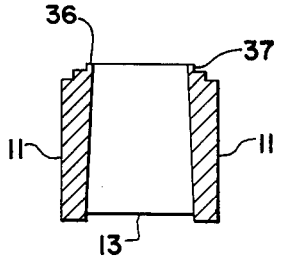
FIG. 13 is a sectional view taken along the line A—A of FIG. 12.
Figure 14:
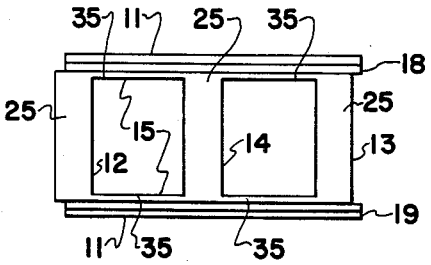
FIG. 14 is a plan view of the upwardly shown extremity of the block illustrated in FIG. 12, and actually a view of the underside of the block.

In the embodiment of the primary building block shown in FIGS. 12–14, interior surfaces 15 of the sidewalls are downwardly tapered in an inwardly convergent manner. This causes the transverse walls to deviate slightly from a rectangular outer perimeter, said perimeter having instead a trapezoidal shape. The tapered effect also causes the sidewalls to be thicker adjacent their lower extremities. The increased thickness permits the existence of connecting shoulders 35 which span the distance between the transverse walls and terminate in a downwardly facing surface 36 coplanar with the lower edge surfaces 25 of said transverse walls. The shoulders are further bounded by outer vertical walls 37 spaced apart across a block by a distance which permits insertion between the interior surfaces of the sidewalls of the top of a next adjacent block.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A building block of integral monolithic construction comprising:

(a) two identical sidewalls of rectangular perimeter, each having (1) an interior surface, (2) a flat exterior surface, (3) a flat straight upper abutment edge surface which spans the distance between said interior and exterior surfaces, (4) a lower edge disposed below the corresponding upper abutment edge and parallel thereto in spanning relationship between said interior and exterior surfaces and having at least two steps, the first of said steps being a flat straight abutment surface contiguous to said interior surface, the second of said steps extending between said first step and said exterior surface, and positioned closer to said upper abutment edge than said first step, and (5) first and second vertical edge surfaces of flat straight configuration perpendicularly disposed between said interior and exterior surfaces, the corresponding several edge surfaces of the two sidewalls being in coplanar alignment, and (b) first and second transverse walls located adjacent said first and second vertical edge surfaces, respectively, and disposed between the facing interior surfaces of said sidewalls in perpendicular spanning relationship therewith, each transverse wall being of substantially rectangular perimeter and bounded by a flat exterior abutment surface, an interior surface, and upper and lower edge surfaces perpendicularly disposed between interior and exterior surfaces of the transverse wall, the lower edge surfaces of said transverse walls being disposed below the lower edge surfaces of said sidewalls, the upper edge surfaces of said transverse walls being disposed below the upper edge surfaces of said sidewalls, the positioning of said first transverse wall being such that its exterior abutment surface is located forwardly of said first vertical edge surfaces, and the positioning of said second transverse wall being such that its exterior abutment surface is inwardly displaced from said second vertical edge surfaces in the direction of said first transverse wall, whereby (c) the lower extremities of the transverse walls of the building block make snug interlocking contact with the interior surfaces of the sidewalls of an underlying building block of the same construction, and (d) when placed end to end, the first transverse wall of a building block partially enters the interior space between the sidewalls of a horizontally adjacent building block, interlocking therewith and causing the flat exterior abutment surface of the first transverse wall of one building block to contact the flat exterior abutment surface of the second transverse wall of the next horizontally adjacent building block, (e) said interactive abutment of the building block with identical underlying and horizontally adjacent building blocks causing formation of horizontal and vertical troughs, respectively.

2. The building block of claim 1 having a third transverse wall located midway between said first and second transverse walls and parallel thereto.

3. The building block of claim 2 wherein the interior surfaces of the sidewalls are downwardly tapered in an inwardly convergent manner, thereby causing the sidewall to be thicker at the bottom of the block.

4. A vertical structural wall comprised of a multitude of the building blocks of claim 1 in abutment in horizontal and vertical directions, said wall having continuous horizontal troughs and uniformly spaced discontinuous vertical troughs.

5. The wall of claim 4 wherein said troughs are filled with a bonding agent.

* * * * *